US009695657B2

(12) United States Patent
Harms

(10) Patent No.: US 9,695,657 B2
(45) Date of Patent: Jul. 4, 2017

(54) DOWNHOLE LATCH ASSEMBLY

(71) Applicant: Halliburton Energy Services, Inc., Houston, TX (US)

(72) Inventor: Timothy E. Harms, The Colony, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 226 days.

(21) Appl. No.: 14/400,774

(22) PCT Filed: Dec. 20, 2013

(86) PCT No.: PCT/US2013/076899

§ 371 (c)(1),
(2) Date: Nov. 12, 2014

(87) PCT Pub. No.: WO2015/094338

PCT Pub. Date: Jun. 25, 2015

(65) Prior Publication Data

US 2016/0273290 A1 Sep. 22, 2016

(51) Int. Cl.

| | |
|---|---|
| ***E21B 23/02*** | (2006.01) |
| ***E21B 17/046*** | (2006.01) |
| ***E21B 17/06*** | (2006.01) |
| ***E21B 23/01*** | (2006.01) |

(52) U.S. Cl.

CPC ..... *E21B 23/02* (2013.01); *E21B 17/046* (2013.01); *E21B 17/06* (2013.01); *E21B 23/01* (2013.01)

(58) Field of Classification Search
None
See application file for complete search history.

(56) References Cited

U.S. PATENT DOCUMENTS

| | | | |
|---|---|---|---|
| 4,572,289 | A | 2/1986 | Rosenthal |
| 4,681,166 | A | 7/1987 | Cuiper |
| 6,220,348 | B1 | 4/2001 | Serafin et al. |
| 2008/0001111 | A1 | 1/2008 | Ross |
| 2010/0025047 | A1 | 2/2010 | Sokol et al. |

OTHER PUBLICATIONS

International Search Report and the Written Opinion of the International Searching Authority, or the Declaration, May 6, 2014, PCT/US2013/076899, 9 pages, International Searching Authority, U.S.

*Primary Examiner* — Caroline Butcher

(57) ABSTRACT

An assembly and method of latching an upper completion mandrel to a lower completion receptacle that is located downhole to prevent or limit movement between the mandrel and the receptacle. The method includes lowering the mandrel having a latch assembly carried by the mandrel to a first position relative to the receptacle, raising the mandrel to position the latch assembly in a second position relative to the receptacle, and lowering the mandrel to position the latch assembly in a third position relative to the receptacle to limit upward and downward movement of the mandrel relative to the receptacle.

13 Claims, 15 Drawing Sheets

DOWNHOLE LATCH ASSEMBLY

CROSS REFERENCE TO RELATED APPLICATIONS

The present application is a U.S. National Stage patent application of International Patent Application No. PCT/US2013/076899, filed on Dec. 20, 2013, the benefit of which is claimed and the disclosure of which is incorporated herein by reference in its entirety.

TECHNICAL FIELD

The present disclosure relates generally to well completion operations and, more specifically, to latching a mandrel to a receptacle using a latch assembly to limit movement between the mandrel and the receptacle.

BACKGROUND

In conventional well completion operations, a tubing string, including an upper completion assembly having a mandrel, is lowered downhole to couple to a lower completion assembly having a receptacle. The upper completion assembly is latched to the lower completion assembly using the mandrel and the receptacle. For example, a latch couples a shear plug to sand control tubing, with a sand control installation located below the shear plug. Pumping operations results in a repetitive up-and-down motion of the shear plug relative to the tubing if there is "play" in the latch that is formed between the shear plug and the sand control tubing. This movement or play within the latch could damage the sand control installation.

In view of the foregoing, there is a need in the art for a latch assembly in completion systems, which allows for limited or no movement between the mandrel and the receptacle.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
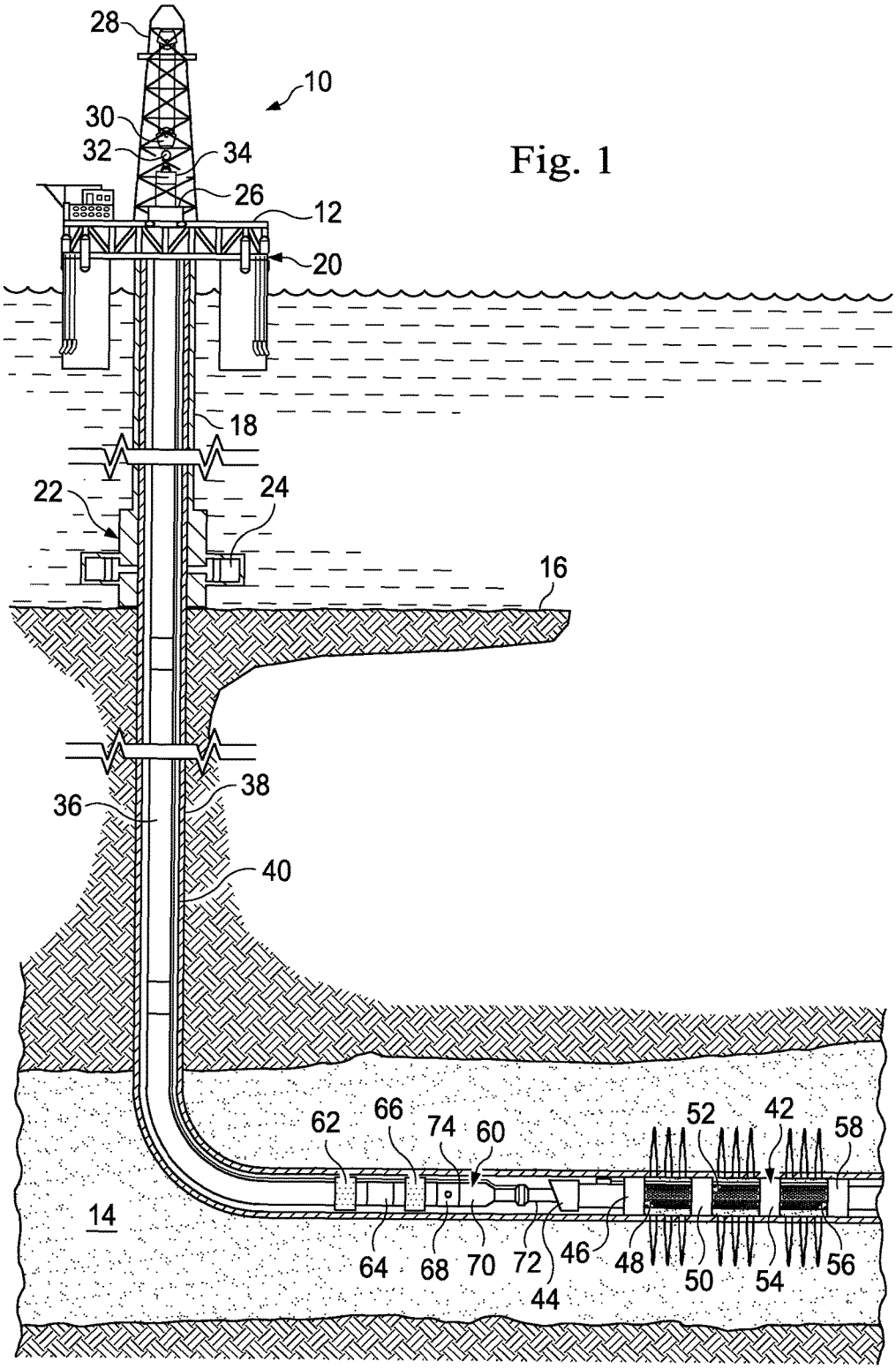
FIG. 1 is a schematic illustration of an offshore oil and gas platform installing, using a latch assembly, an upper completion assembly into a well having a lower completion assembly disposed therein according to an embodiment of the present disclosure.

Illustrative embodiments and related methodologies of the present disclosure are described below as they might be employed in a downhole latch assembly and method of operating the same. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

Referring initially to FIG. 1, an upper completion assembly is being installed in a well having a lower completion assembly disposed therein from an offshore oil or gas platform that is schematically illustrated and generally designated 10. A semi-submersible platform 12 is positioned over a submerged oil and gas formation 14 located below a sea floor 16. A subsea conduit 18 extends from a deck 20 of the platform 12 to a subsea wellhead installation 22, including blowout preventers 24. The platform 12 has a hoisting apparatus 26, a derrick 28, a travel block 30, a hook 32 and a swivel 34 for raising and lowering pipe strings, such as a substantially tubular, axially extending tubing string 36.

A wellbore 38 extends through the various earth strata including the formation 14 and has a casing string 40 cemented therein. Disposed in a substantially horizontal portion of the wellbore 38 is a lower completion assembly 42 that includes various tools such as a latch subassembly 44, a packer 46, a sand control screen assembly 48, a packer 50, a sand control screen assembly 52, a packer 54, a sand control screen assembly 56, and a packer 58.

Disposed in the wellbore 38 at the lower end of the tubing string 36 is an upper completion assembly 60 that includes various tools such as a packer 62, an expansion joint 64, a packer 66, a fluid flow control module 68, and an anchor assembly 70. The upper completion assembly 64 also includes a latch subassembly 72. Extending uphole from the upper completion assembly 60 are one or more communication cables such as an electric cable 74 that passes through the packers 62, 66 and extends to the surface in the annulus between the tubing string 36 and the casing 40. The latch subassembly 42 couples to the latch subassembly 72 to form a latch assembly 76.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
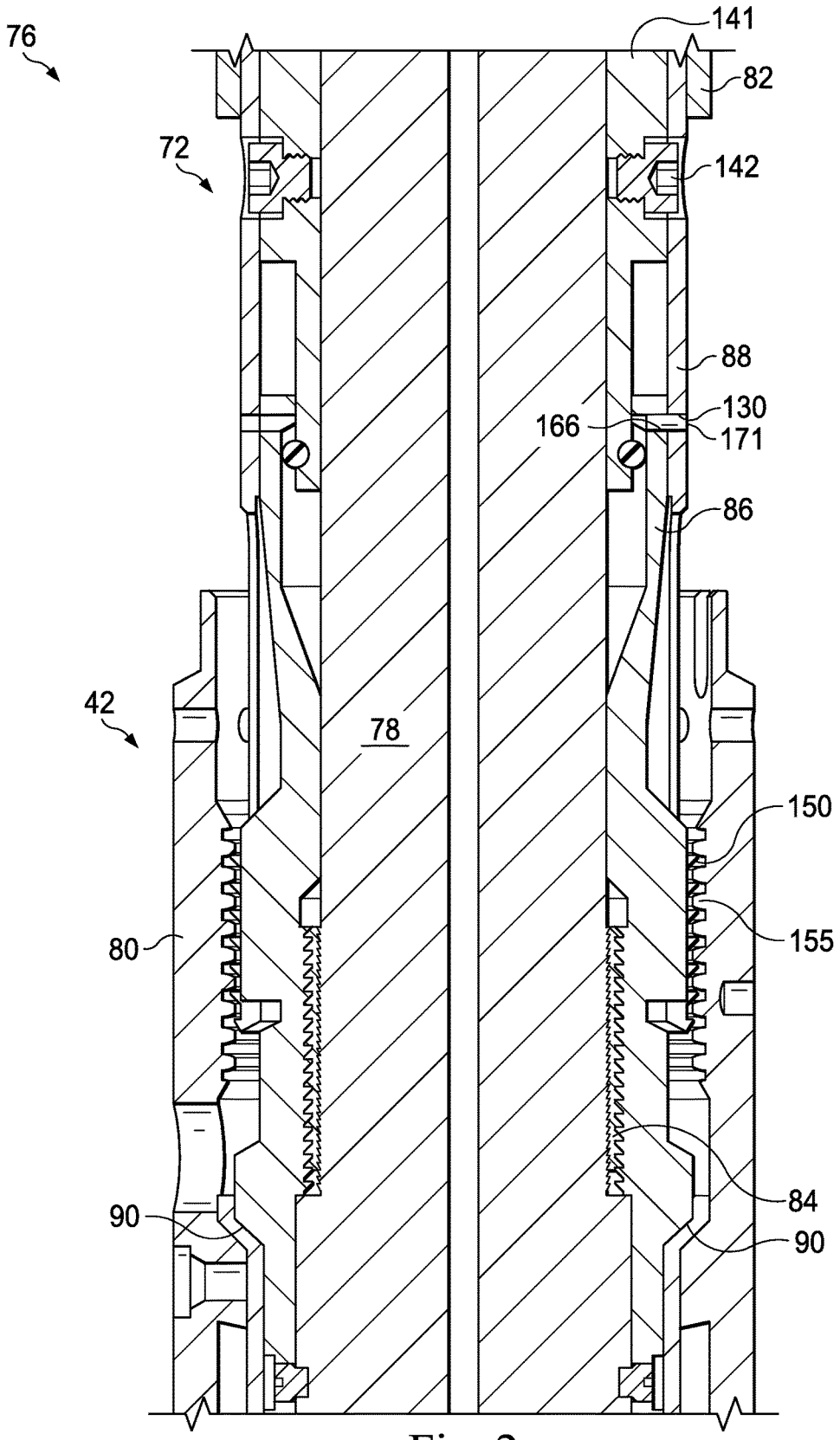
FIG. 2 illustrates a cross-sectional view of the latch assembly of FIG. 1, according to an exemplary embodiment of the present disclosure, the latch assembly in an engagement position and including a mandrel, a body lock ring, a collet support, and a collet.

FIG. 2 is a cross-sectional view of the latch assembly 76 according to an exemplary embodiment of the present disclosure. The latch subassembly 72 includes a locator or mandrel 78 disposed within a receptacle 80 of the latch subassembly 42. An outer tubular, or sub 82 is connected to an upper portion (towards the wellhead) of the mandrel 78, and the mandrel 78 latches to the receptacle 80 at a location below the sub 82. Those ordinarily skilled in the art having the benefit of this disclosure realize there are a variety of pipes or tubulars that may be utilized as the mandrel 78 and/or the receptacle 80. For example, the receptacle 80 may be attached to a sub-packer, a gravel pack packer, or a liner hanger or a component thereof.

As will be described herein, the sub 82 transfers loads to the mandrel 78 in order to latch the mandrel 78 of the latch subassembly 72 to the receptacle 80 of to the latch subassembly 44. The latch assembly 76 also includes a body lock ring 84 and a collet support 86 that are concentrically disposed between a collet 88 and the mandrel 78 to prevent or limit movement of the mandrel 78 in the upward direction (towards the wellhead). As will be described, the body lock ring 84, the collet support 86, and the collet 88 function to ensure that when the mandrel 78 of the latch subassembly 72 is fully engaged with the receptacle 80 of the latch subassembly 44, shoulders 90 of the mandrel 78 rest on a mating shoulder 92 of the receptacle 80 to prevent or limit relative movement there between.

Figure 3:
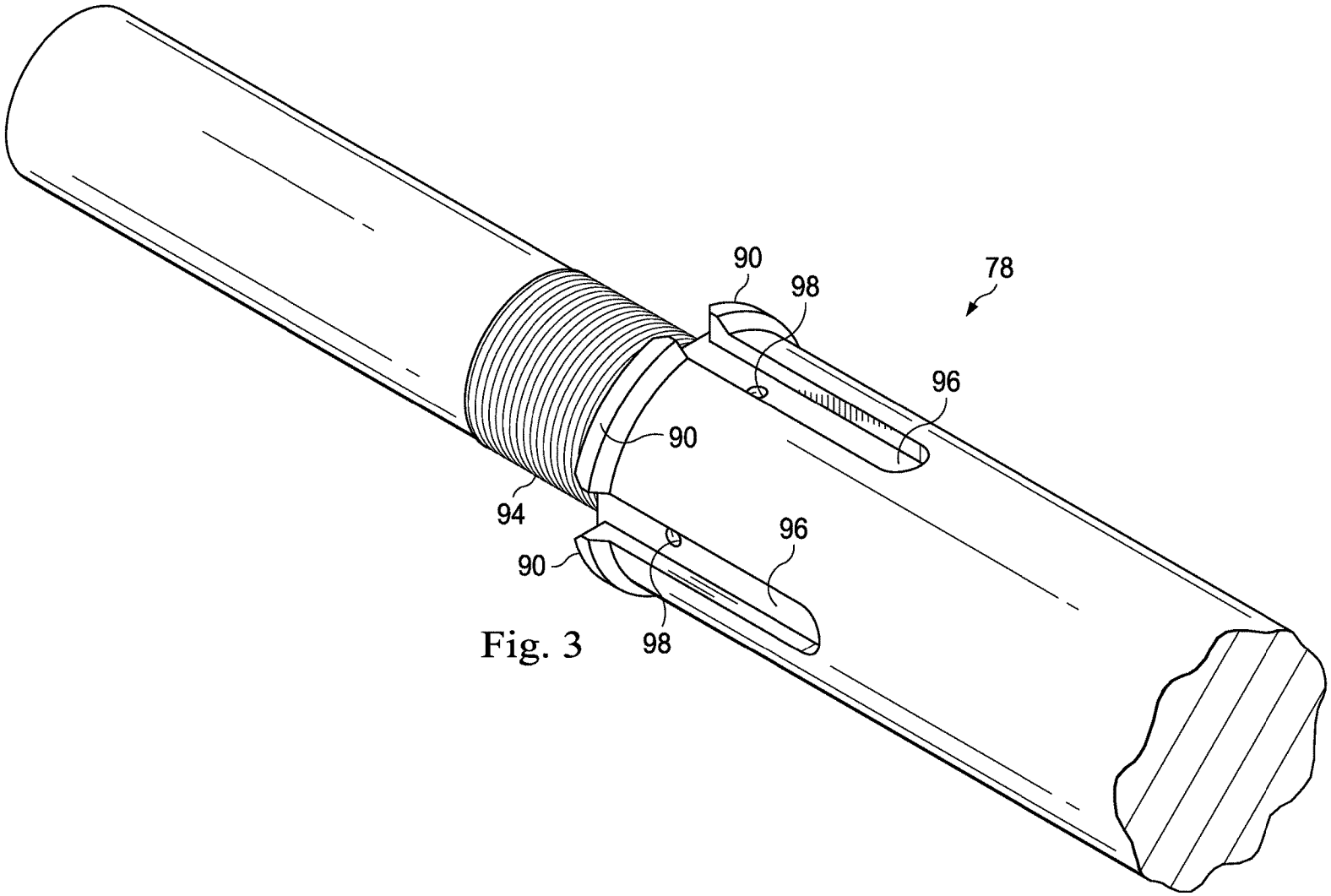
FIG. 3 illustrates a perspective view of the mandrel of FIG. 2, according to an exemplary embodiment of the present disclosure.

FIG. 3 illustrates the mandrel 78 having an exterior surface forming teeth 94. In an exemplary embodiment, the teeth 94 are double lead 24 pitch teeth directed in the upward direction. As shown, the mandrel 78 includes the shoulders 90 that extend radially outwards. A plurality of circumferentially-positioned, axially extending slots 96 are formed on the mandrel 78. Each of the slots 96 has a bore 98 configured to receive a shear mechanism, such as a pin or screw.

Figure 4:
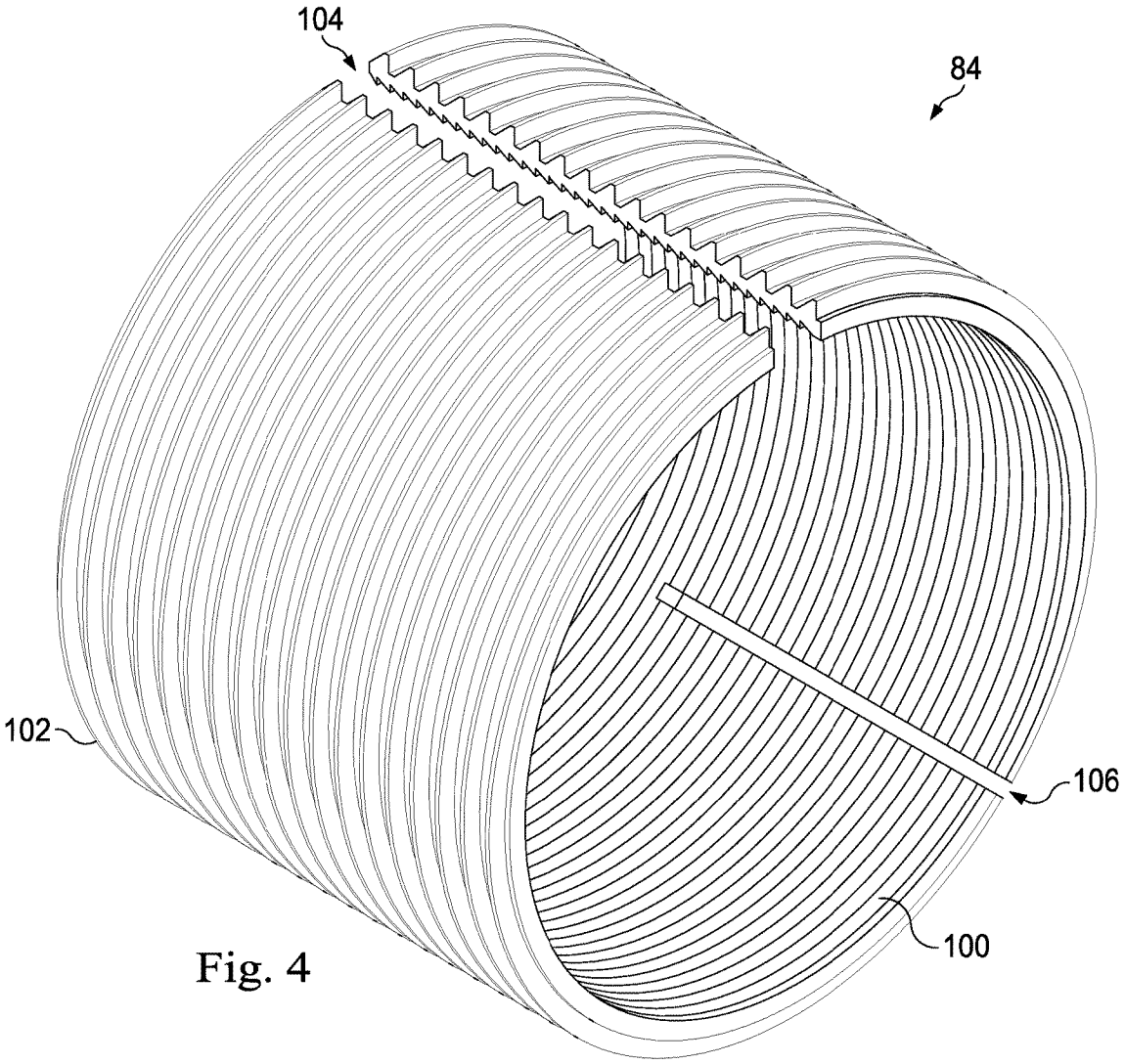
FIG. 4 illustrates a perspective view of the body lock ring of FIG. 2, according to an exemplary embodiment of the present disclosure.

FIG. 4 illustrates the body lock ring 84. The body lock ring 84 is a generally tubular ring or sleeve that has an inner surface forming teeth 100 directed in the downward direction and an exterior surface forming teeth 102 directed in the downward direction. In some embodiments, the body lock ring 84 may be a c-ring or a c-sleeve having a longitudinally extending opening 104 to allow for the body lock ring 84 to be installed on, and removed from, the mandrel 78. The body lock ring 84 is configured to be concentrically disposed about the exterior surface of the mandrel 78 so that the teeth 94 of the mandrel 78 (shown in FIG. 3) engage the teeth 100 of the body lock ring 84. The teeth 100 are configured to engage the teeth 94 to form a linear ratchet that prevents upward movement of the mandrel 78 relative to the body lock ring 84. In one embodiment, the teeth 100 are 12 pitch teeth and the teeth 102 are 8 pitch teeth. In an exemplary embodiment, an axially extending slit 106 may be formed in the body lock ring 84 to aid in the installation and removal of the body lock ring 84 from the mandrel 78. However, in some exemplary embodiments, the axially extending slit 106 may be omitted from the body lock ring 84.

Figure 5:
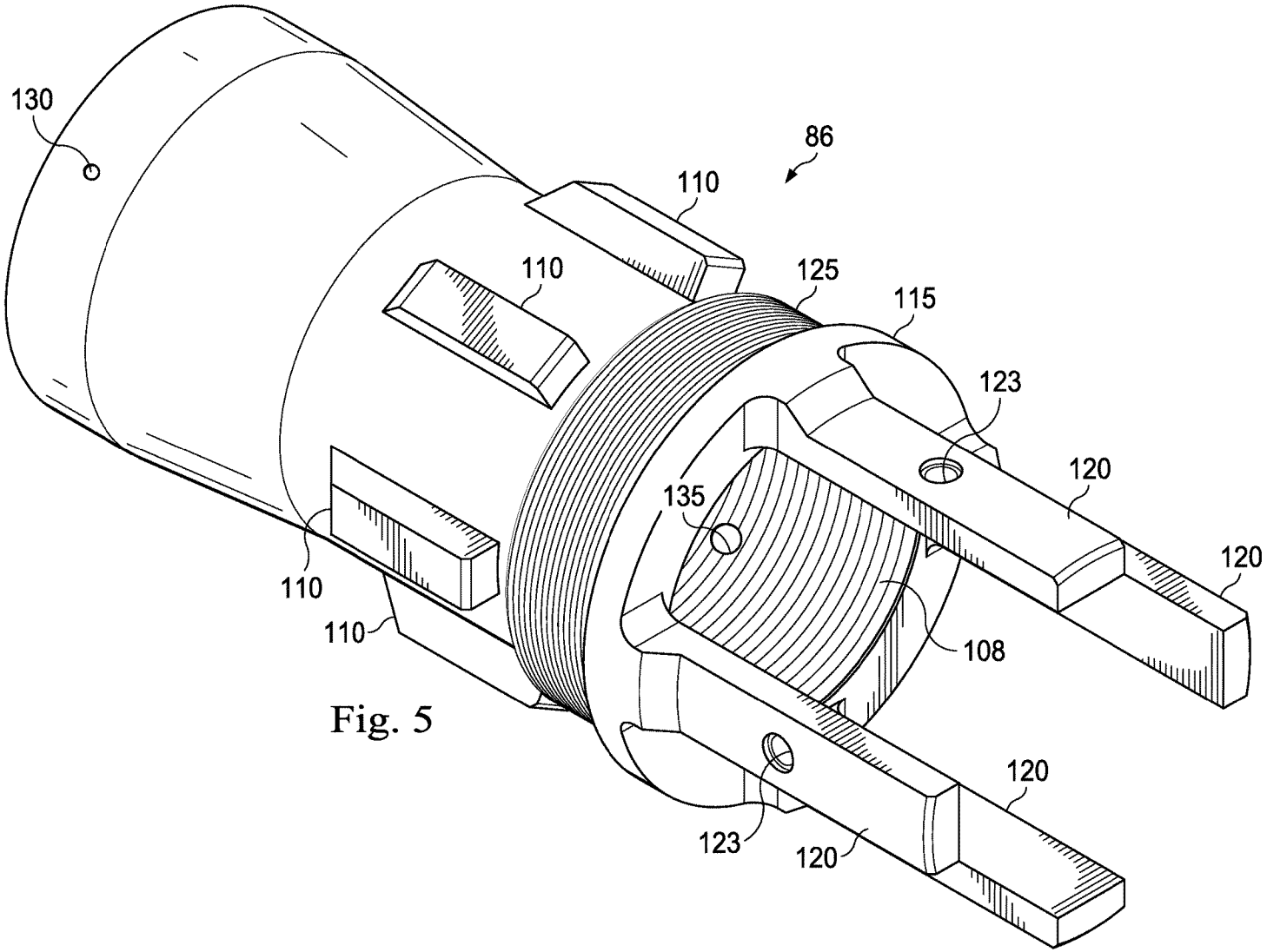
FIG. 5 illustrates a perspective view of the collet support of FIG. 2, according to an exemplary embodiment of the present disclosure.

FIG. 5 illustrates the collet support 86. The collet support 86 is configured to be concentrically disposed about the exterior surface of the mandrel 78 and about the exterior surface of the body lock ring 84. As shown, an inner surface of the collet support 86 forms teeth 108 directed in the upward direction. The teeth 108 are configured to engage the teeth 102 (shown in FIG. 4) of the body lock ring 84 to form a linear ratchet that prevents downward movement of the body lock ring 84 relative to the collet support 86. In an exemplary embodiment, the teeth 108 are 8 pitch teeth. The collet support 86 has circumferentially-positioned, rotational lugs 110. The collet support 86 also has a radially extending shoulder 115 with circumferentially-positioned fingers 120 extending from the shoulder 115. Each of the fingers 120 has a bore 123 configured to receive a shear mechanism. In one embodiment, each bore 123 is threaded and disposed to receive a shear screw. Each of the fingers 120 is configured to be accommodated within one of the slots 96 of the mandrel 78 (shown in FIG. 3) so that the fingers 120 transfer torque to the mandrel 78 upon rotation of the collet support 86. An exterior surface of the collet support 86 forms teeth 125 directed in the downward direction. The teeth 125 are located between, along the longitudinal axis of the collet support 86, the shoulder 115 and the rotational lugs 110. A bore 135 is also formed through the collet support 86 to allow access to the body lock ring 84 for manipulation, such as by snap ring pliers or other tools. Bores 130 (only one bore 130 shown in FIG. 5) are located near an upper portion of the collet support 86 and each is configured to receive a shear mechanism. In an exemplary embodiment, each of the bores 130 is threaded and disposed to receive a shear screw.

Figure 6:
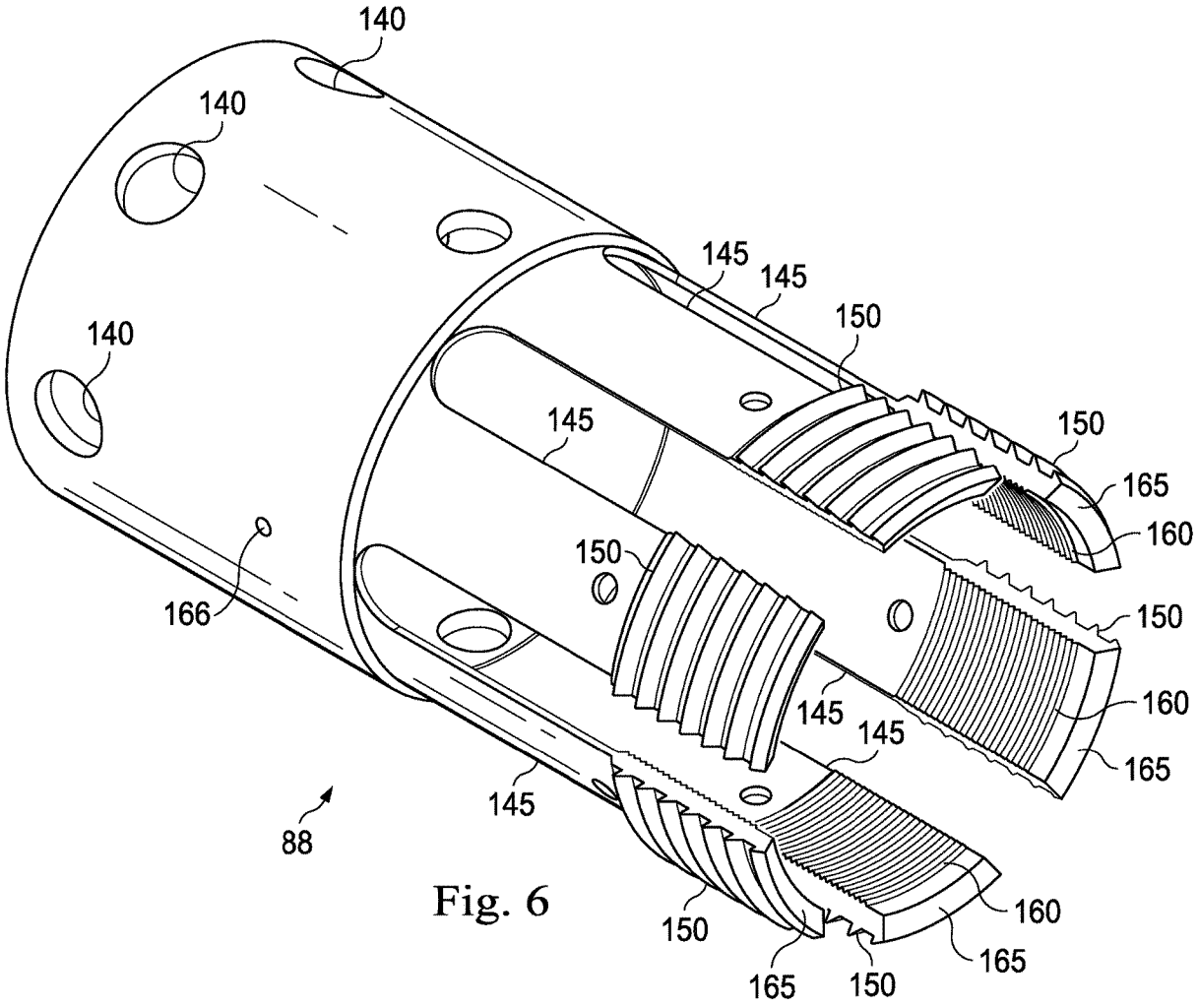
FIG. 6 illustrates a perspective view of the collet of FIG. 2, according to an exemplary embodiment of the present disclosure.

FIG. 6 illustrates the collet 88. The collet 88 is configured to be concentrically disposed about the exterior surface of the collet support 86. A plurality of circumferentially-positioned bores 140 are formed near a top portion of the collet 88 and are configured to receive a fastener to secure the collet to a sleeve 141 (shown in FIG. 2) that is concentrically disposed around and coupled to the mandrel 78 using screws 142 (shown in FIG. 2). The collet 88 includes circumferentially-positioned, axially extending arms 145. The exterior surface of the collet arms 145 forms teeth 150 directed in the upward direction. The teeth 150 are configured to engage the teeth 155 (shown in FIG. 2) that are formed on an inner surface of the receptacle 80 to form a linear ratchet that prevents upward movement of the collet 88 relative to the receptacle 80. The interior surface of the collet arms 145 forms teeth 160 directed in the upward direction. The teeth 160 are configured to engage the teeth 125 of the collet support 86 (shown in FIG. 5) to form a linear ratchet that prevents downward movement of the collet support 86 relative to the collet 88. The collet arms 145 are flexible and are configured to move outward radially when pressure is applied to the collet arms 145 in a radially outward direction. A bottom face 165 is located on a bottom surface of each of the collet arms 145. The bottom face 165 is configured to engage the shoulders 90 of the mandrel 78 (shown in FIG. 2). Bores 166 (only one bore 166 shown in FIG. 6) are located above the plurality of collet arms 145 and each is configured to receive a shear mechanism. In an exemplary embodiment, each of the bores 166 is threaded and disposed to receive a shear screw.

Figure 7A:
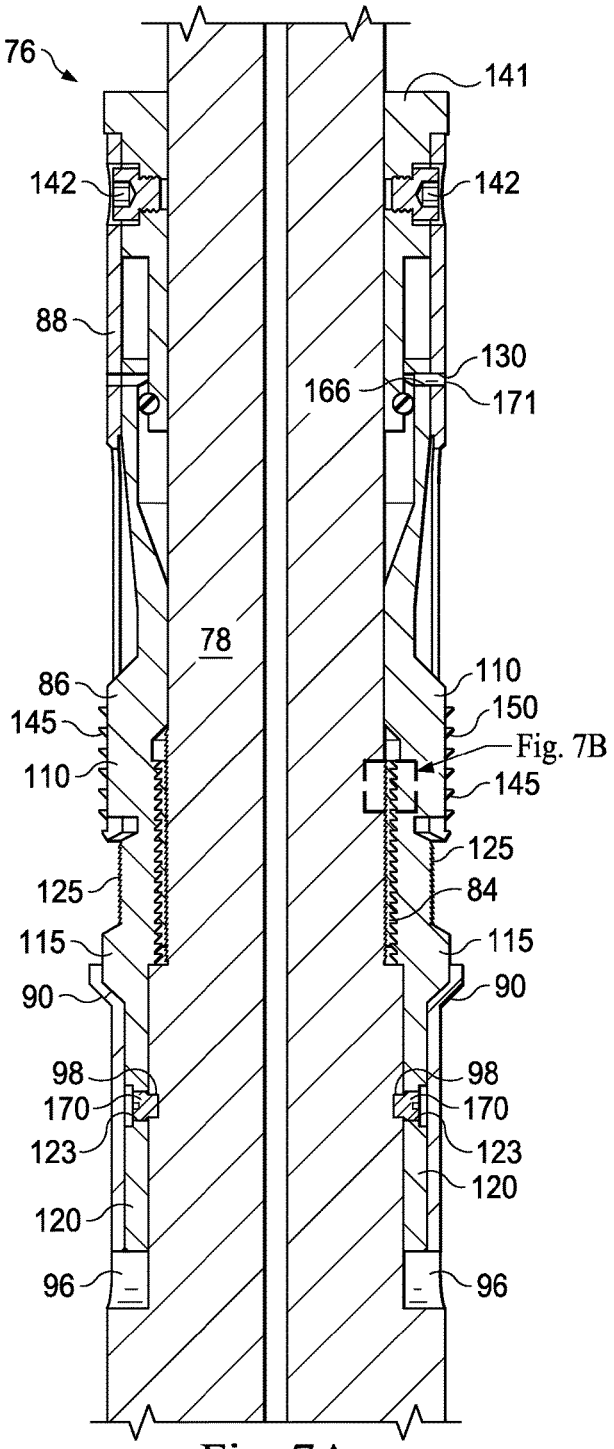
FIG. 7A illustrates a cross sectional view of a portion of the latch assembly of FIG. 2, according to an exemplary embodiment of the present disclosure.
Figure 7B:
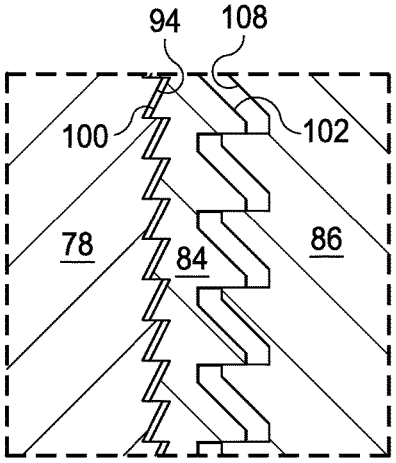
FIG. 7B is an enlarged view of a portion of FIG. 7A, according to an exemplary embodiment of the present disclosure.

During initial deployment downhole, and as illustrated in FIGS. 7A and 7B, the body lock ring 84 is concentrically disposed about the exterior surface of the mandrel 78 so that the teeth 100 engage the teeth 94 to form a linear ratchet that prevents upward movement of the mandrel 78 relative to the body lock ring 84. The collet support 86 is concentrically disposed about the exterior of the body lock ring 84 and about the exterior of the mandrel 78 so that the teeth 108 engage the teeth 102 to form a linear ratchet that prevents downward movement of the body lock ring 84 relative to the collet support 86. Each of the fingers 120 is disposed within one of the slots 96, so that the shoulders 90 engage the shoulder 115 of the collet support 86. The collet support 86 is shearably attached to the mandrel 78 by shear mechanisms 170, which extend through the bores 123 of the collet support 86 and the bores 98 of the mandrel 78. The shear mechanisms 170 assist in attaching the collet support 86 to the mandrel 78 during deployment and subsequent latching operations, as will be described. The shear mechanisms 170 are matched so each will shear under a predetermined load. In some embodiment, the load may be approximately 5,000 lbs. The collet 88 is shearably attached to the collet support 86 by shear mechanisms 171, which extend through the bores 166 of the collet 88 and the bores 130 of collet support 86. The shear mechanisms 171 assist in attaching the collet 88 to the collet support 86 during deployment and subsequent latching operations, as will be described. The collet 88 is concentrically disposed about the exterior surface of the collet support 86 so that each of the rotational lugs 110 are interposed between two of the collet arms 145. The collet 88 is attached to a sleeve 141 that is concentrically disposed and coupled to the mandrel 78 by screws 142, which extend through the bores 140 of the collet 88 and through the sleeve 141. The collet 88 is attached to the sleeve 141 so that the teeth 160 (not shown in FIG. 6) are located between two of the rotational lugs 110 and generally above the teeth 125 of the collet support 86.

Figure 8:
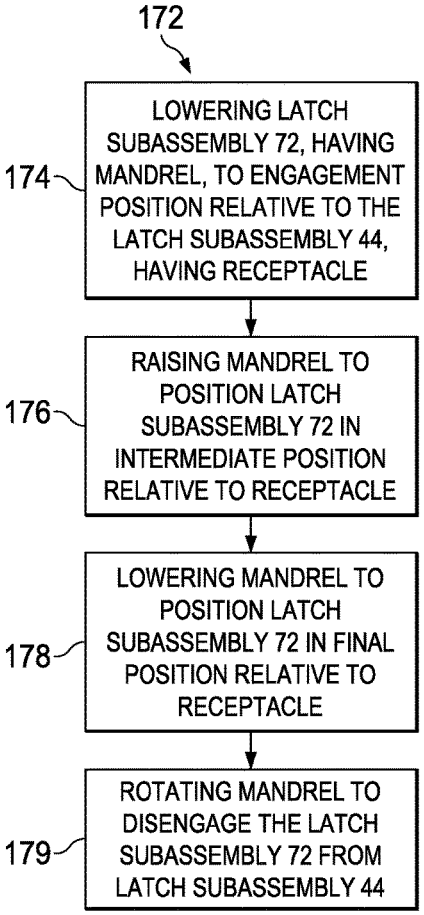
FIG. 8 illustrates a method of operating the latch assembly of FIG. 2, according to an exemplary embodiment of the present disclosure.

In an exemplary embodiment, as illustrated in FIG. 8 with continuing reference to FIGS. 1-7, a method of operating the latch assembly 76 is generally referred to by the reference numeral 172 and includes lowering the latch subassembly 72, having the mandrel 78, to an engagement position relative to the latch subassembly 44, having the receptacle 80, at step 174, raising the mandrel 78 to position the latch subassembly 72 in an intermediate position relative to the receptacle 80 at step 176, lowering the mandrel 78 to position the latch subassembly 72 in a final position relative to the receptacle 80 at step 178, and rotating the mandrel 78 to disengage the latch subassembly 72 from the latch subassembly 44 at the step 179.

In an exemplary embodiment and referring back to FIG. 2, the latch subassembly 72, having the mandrel 78, is lowered to the engagement position relative to the latch subassembly 44, having the receptacle 80, at the step 174. To begin latching the latch subassembly 72 to the latch subassembly 44, the latch subassembly 72 is placed downhole and lowered until the mandrel 78 is disposed within the receptacle 80 of the latch subassembly 44. That is, the shoulders 90 of the collet support 86 rest on the mating shoulder 92 of the receptacle 80. In an exemplary embodiment, approximately 100,000 lbs. of downward force is applied to ensure that the shoulders 90 of the collect support 86 and the shoulder 92 of the receptacle 80 are in contact. Resting the shoulders 90 of the mandrel 78 on the shoulder 92 of the receptacle 80 aligns the teeth 150 of the collet 88 with the teeth 155 of the receptacle 80 to engage the linear ratchet and therefore prevents upward movement of the collet 88 relative to the receptacle 80.

Figure 9A:
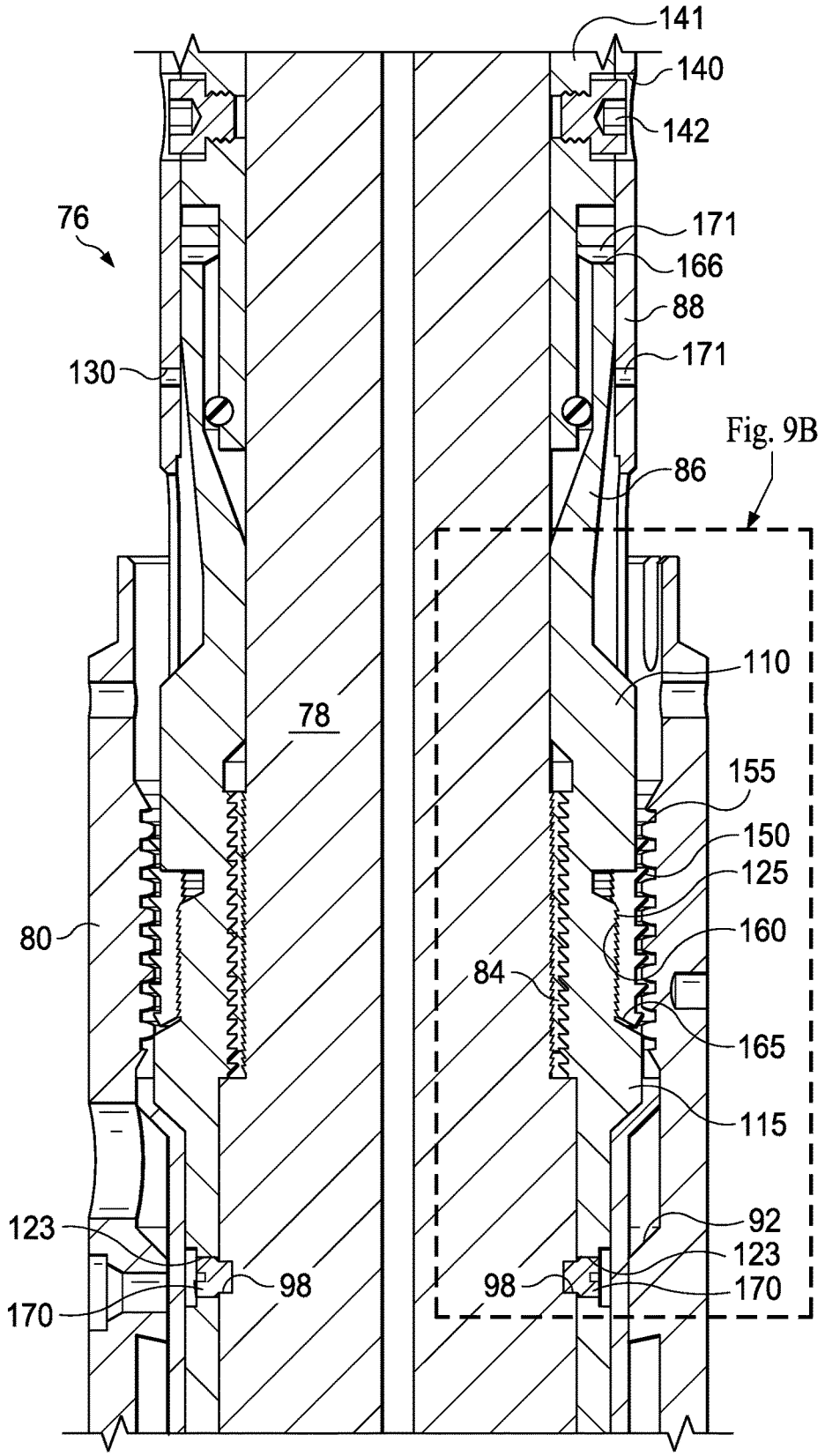
FIG. 9A illustrates a cross sectional view of the latch assembly of FIG. 2 during the execution of a step of the method of FIG. 8, according to an exemplary embodiment of the present disclosure.
Figure 9B:
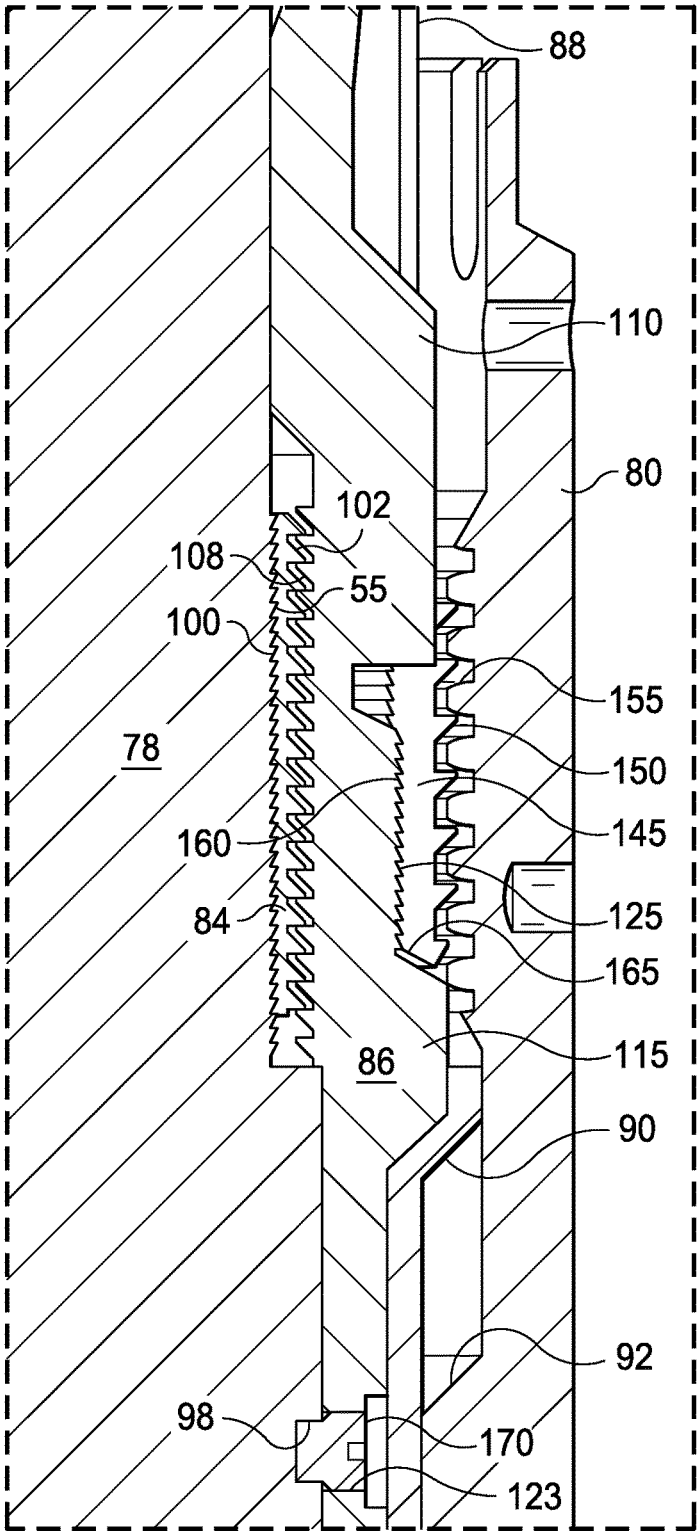
FIG. 9B is an enlarged view of a portion of FIG. 9A, according to an exemplary embodiment of the present disclosure.

After the step 174, the mandrel 78 is raised to position the latch subassembly 72 in the intermediate position relative to the receptacle 80 at the step 176. FIGS. 9A and 9B illustrate the latch subassembly 72 in the intermediate position, relative to the receptacle 80, according to an exemplary embodiment of the present disclosure. After the linear ratchet formed between the teeth 155 and the teeth 150 has been engaged, the sub 82 (shown in FIG. 2) applies an upward tension to the mandrel 78. As the collet support 86 is shearably attached to the mandrel 78 with shear screws 170, upward tension is also applied to the collet support 86. This upward tension results in longitudinal pressure being applied to the shear screws 171, thereby shearing the shear screws 171 to allow the collet support 86 to move in the upward direction relative to the collet 88. The collet support 86 moves in the upward direction along with the mandrel 78 until the shoulder 115 of the collet support 86 engages the face 165 of the collet 88. The body lock ring 84 also moves in the upward direction with the mandrel 78. As described above, due to the linear ratchet formed between the teeth 150 and the teeth 155, upward movement of the collet 88 relative to the receptacle 80 is limited or prevented. Any upward movement that does occur is due to clearance of the teeth 150 and the teeth 155 or due to backlash in the linear ratchet. Therefore, the face 165 of the collet 88 engages the shoulder 115 to stop the upward movement of the mandrel 78, the body lock ring 84, and the collet support 86 relative to the receptacle 80. The upward movement of the collet support 86 causes the teeth 125 to move in the upward direction, thereby engaging the teeth 160 to create a linear ratchet to prevent the downward movement of the collet support 86 relative to the collet 88. The collet support 86 is secured in the intermediate position due to the shoulder 115 preventing upward movement of the collet support 86, and due to the linear ratchet formed between the collet support 86 and the collet 88 preventing downward movement of the collet support 86. When in the intermediate position, the collet support 86 pushes the teeth 150 radially outwards and towards the teeth 155. This outward force prevents the teeth 150 from disengaging from the teeth 155, and thereby secures the collet 88 to the receptacle 80. In the intermediate position, the shoulder 115 is coupled the shoulders 90.

Figure 10A:
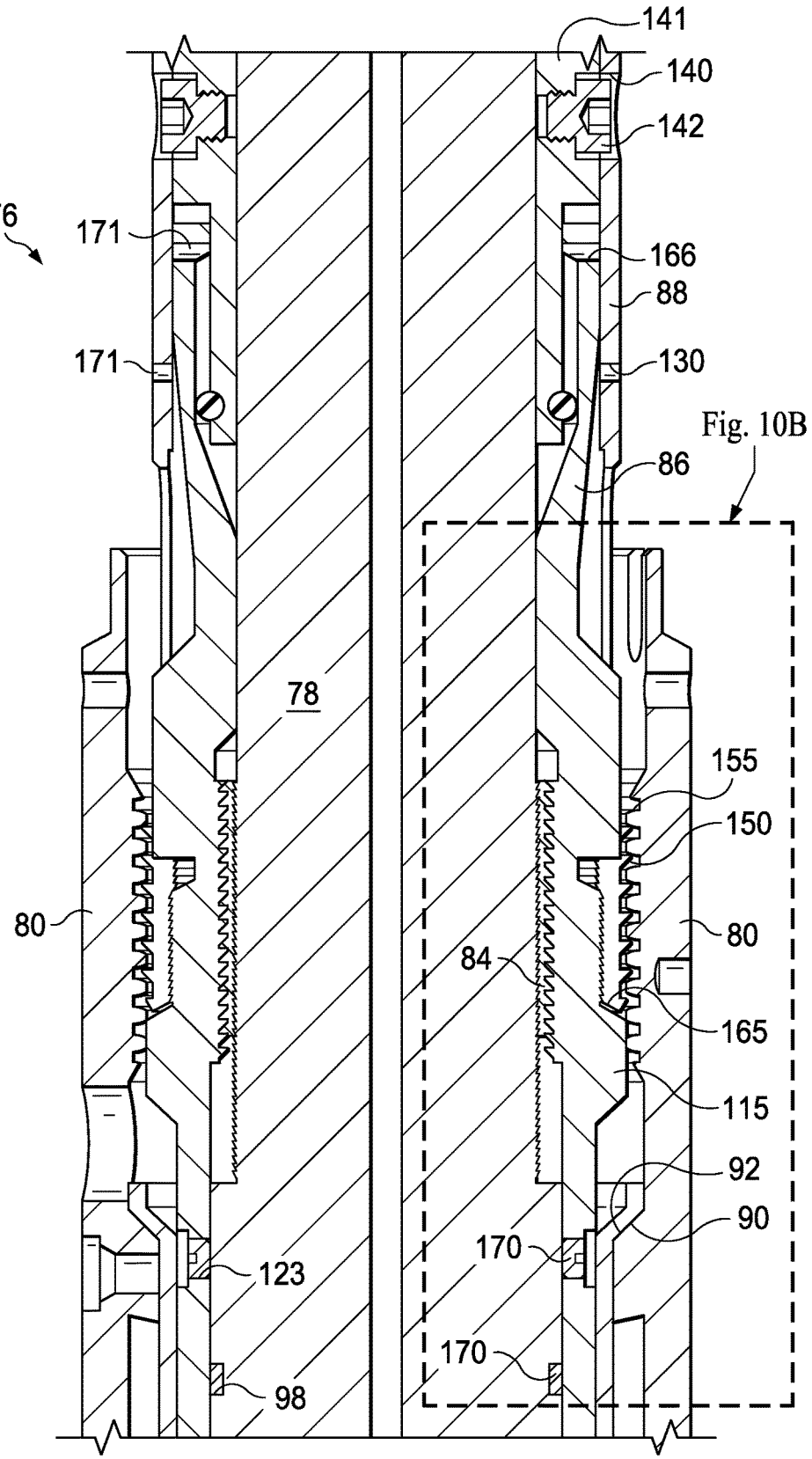
FIG. 10A illustrates a cross sectional view of the latch assembly of FIG. 2 during the execution of yet another step of the method of FIG. 8, according to an exemplary embodiment of the present disclosure.
Figure 10B:
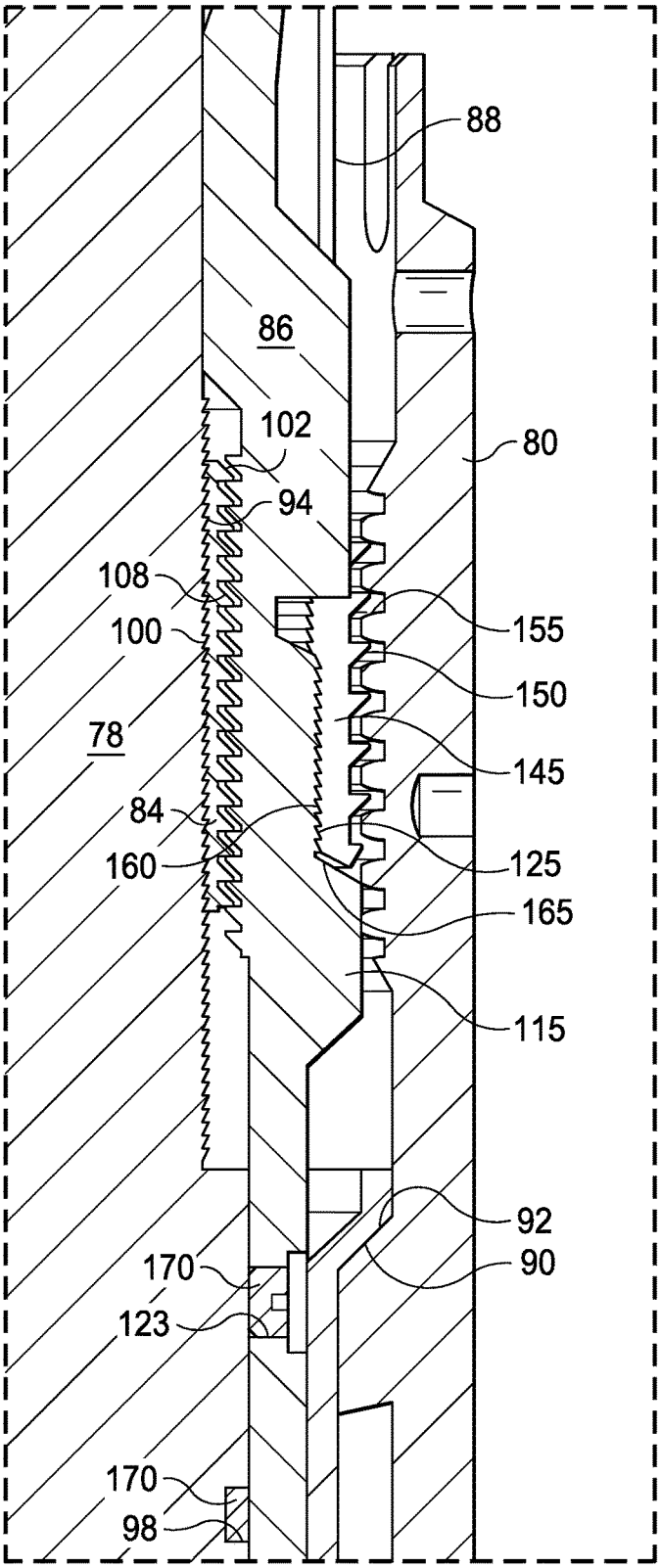
FIG. 10B is an enlarged view of a portion of FIG. 10A, according to an exemplary embodiment of the present disclosure.

After the step 176, the mandrel 78 is lowered to position the latch subassembly 72 in the final position at the step 178. FIGS. 10A and 10B illustrate the latch subassembly 72 in the final position, according to an exemplary embodiment of the present disclosure. After the collet support 86 is latched in the intermediate position, the sub 82 (shown in FIG. 2) transfers a load to the mandrel 78 in the downward direction. Due to the linear ratchets created between the collet 88 and the receptacle 80, the collet support 86 and the collet 88, and the body lock ring 84 and the collet support 86, downward movement of the collet 88, the collet support 86, and the body lock ring 84 is limited or prevented. Any downward movement of the collet 88, the collet support 86, and the body lock ring 84 is limited to the clearance of the teeth or backlash of the linear ratchets. Therefore, due to the downward load on the mandrel 78, a longitudinal pressure is applied to the shear screws 170, thereby shearing the shear screws 170 and allowing the mandrel 78 to move relative to the collet support 86. The mandrel 78 moves downward to disengage the shoulders 90 from the shoulder 115. Downward movement of the mandrel 78 continues until the shoulders 90 contact the shoulder 92. The downward movement of the mandrel 78 engages the linear ratchet formed between the teeth 94 and the teeth 100. Upward movement of the mandrel 78 is prevented or limited due to the linear ratchet created by the teeth 94 and the teeth 100. When the latch subassembly 72 is in the secure position, upward movement of the mandrel 78 is prevented or limited due to the linear ratchet formed between the body lock ring 84 and the mandrel 78, and downward movement of the mandrel 78 is prevented or limited due to the engagement of the shoulders 90 and the shoulder 92.

After the step 178, the mandrel 78 is rotated to disengage the latch subassembly 72 from the latch subassembly 44 at the step 179. The tubing string, including the latch subassembly 72, is configured to be removed from the wellbore. To allow for simple and efficient removal of the latch subassembly 72 from the receptacle 80, the mandrel 78 is rotated. Torque is transferred from the fingers 120 to the collet support 86 using the slots 96 to rotate the collet support 86, thereby releasing the latch subassembly 72 from the latch subassembly 44.

Figure 11:
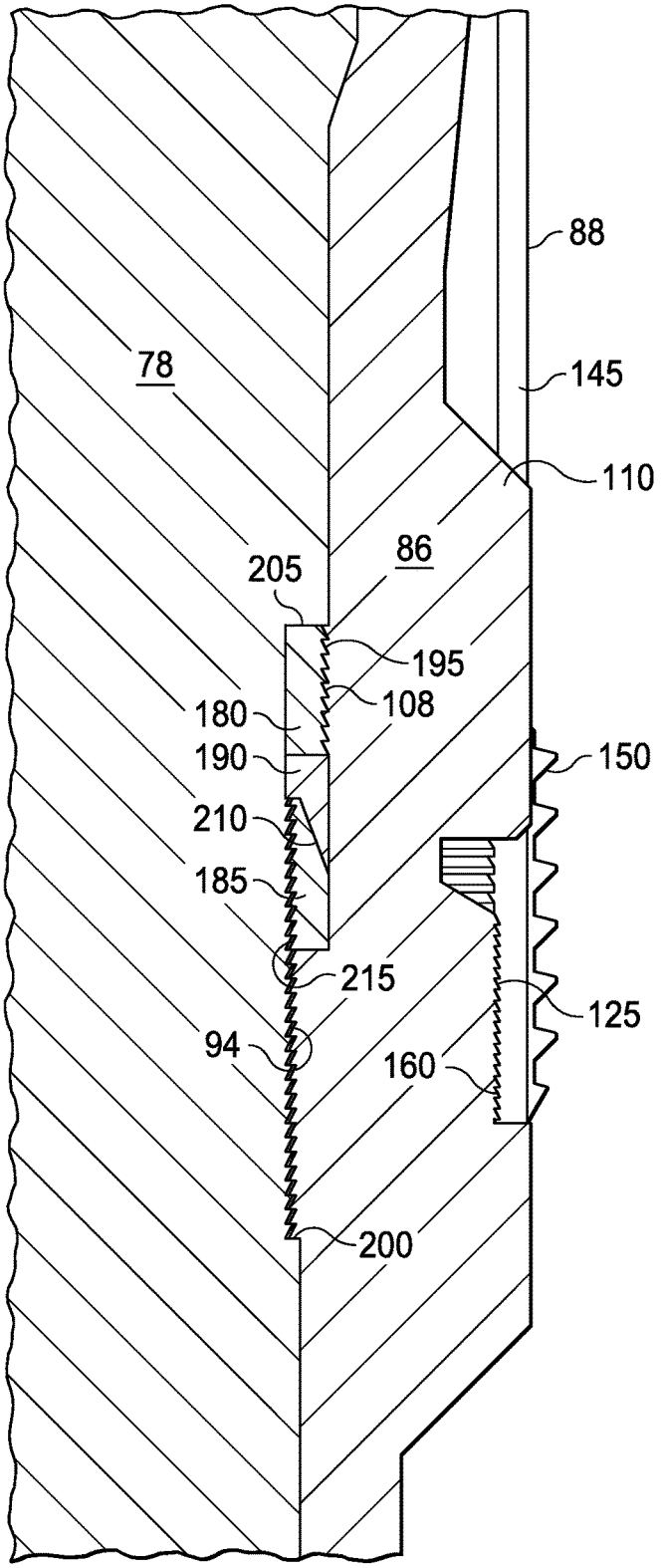
FIG. 11 illustrates a cross sectional view of a portion of the latch assembly of FIG. 2, according to another exemplary embodiment of the present disclosure.

Exemplary embodiments of the present disclosure may be altered in a variety of ways. For example, and as shown in FIG. 11, the body lock ring 84 is replaced with a retainer nut 180, an internal slip 185, and a wedge ring 190 interposed between the retainer nut 180 and the internal slip 185. The retainer nut 180, the internal slip 185, and the wedge ring 190 are concentrically disposed within a channel 200 formed within the exterior surface of the mandrel 78. The channel 200 has an upper shoulder 205 and the teeth 94 are located within the channel 200. The retainer nut 180 is a removable ring or c-sleeve that engages the upper shoulder 205 and that has an external surface forming teeth 195 directed in the downward direction. The teeth 195 engage the teeth 108 to form a linear ratchet between the collet support 86 and the retainer nut 180 similar to the linear ratchet between the collect support 86 and the body lock ring 84. The wedge ring 190 is disposed below the retainer nut 180 and retains the triangularly shaped internal slip 185 within an internal slip chamber 210. The interior surface of the internal slip 185 has teeth 215 directed in the downward direction that engage the teeth 94 of the mandrel 78 to form a linear ratchet formed between the mandrel 78 and the internal slip 185 similar to the linear ratchet between the mandrel 78 and the body lock ring 84. That is, the retainer nut 180, the internal slip 185, and the wedge ring 190 act to prevent or limit movement of the mandrel 78 in the upward direction relative to the receptacle 80 in a manner similar to the body lock ring 84.

Figure 12:
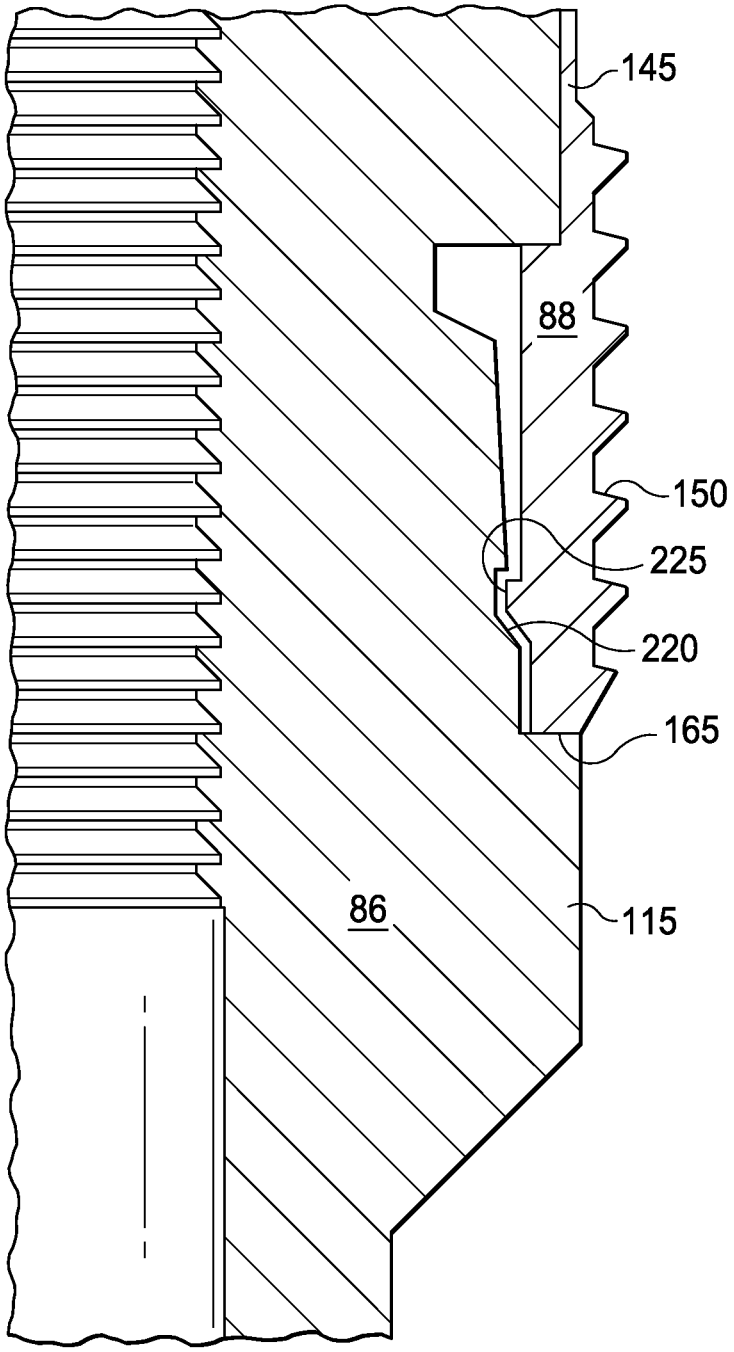
FIG. 12 illustrates a cross sectional view of a portion of the latch assembly of FIG. 2, according to yet another exemplary embodiment of the present disclosure.

In another exemplary embodiment, and as shown in FIG. 12, the teeth 160 and the teeth 125 are omitted from the latch assembly 76. Instead, the exterior surface of the collet support 86 forms a detent 220 above the shoulder 115. The detent 220 is configured to receive a protrusion 225 formed on the interior surface of the collet 88. When the latch subassembly 72 is moved into the intermediate position, the protrusion 225 snaps into the detent 220 and prevents the downward movement of the collet support 86 relative to the collet 88 in a manner similar to the linear latch formed between the teeth 125 and the teeth 160.

Figure 13:
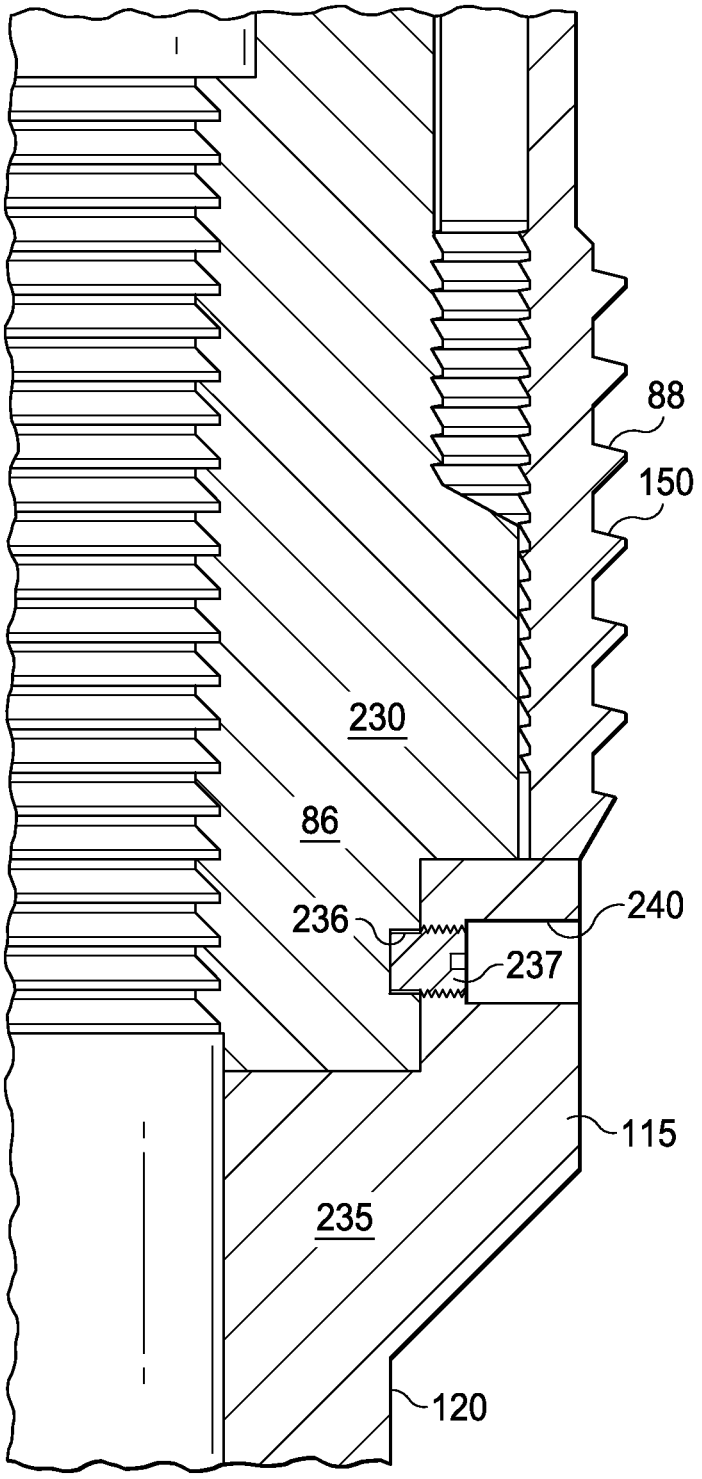
FIG. 13 illustrates a cross sectional view of a portion of the latch assembly of FIG. 2, according to yet another exemplary embodiment of the present disclosure.

In another exemplary embodiment, and as shown in FIG. 13, the collet support 86 includes an upper portion 230 and a lower portion 235, with the upper portion 230 being separate from the lower portion 235. The upper portion 230 forms circumferentially-positioned bores 236 configured to receive shear screws 237 to shearably couple the lower portion 235 to the upper portion 230. The lower portion 235 includes the shoulder 115 and the fingers 120. The lower portion 235 includes circumferentially-positioned bores 240 configured to accommodate the shear screws 237. While the latch subassembly 72 is in the final position, upward tension is applied to the mandrel 78. This upward tension results in longitudinal pressure being applied to the shear screws 237, thereby shearing the shear screws 237 to allow the mandrel 78 to move relative to the receptacle 80 and for removal of the latch subassembly 72 from the latch subassembly 44.

Figure 14:
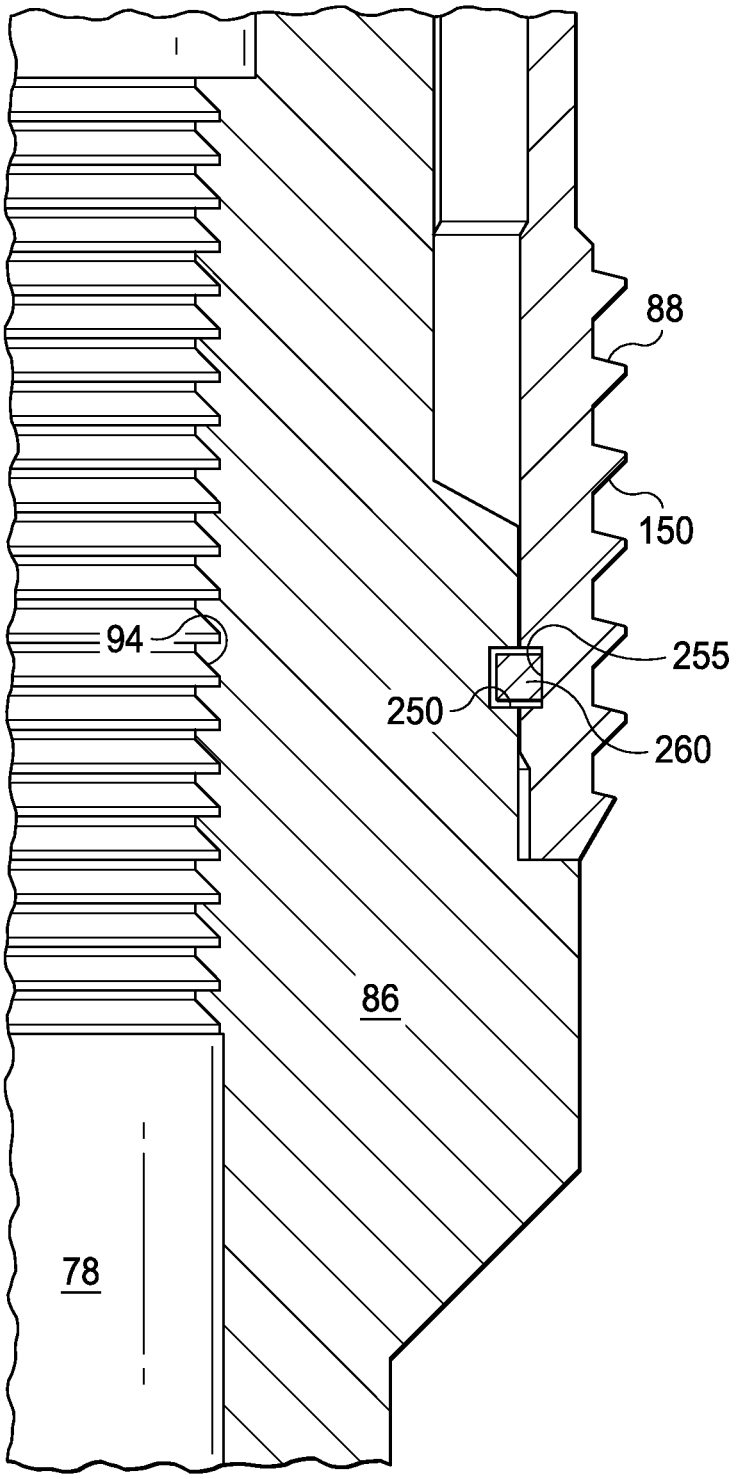
FIG. 14 illustrates a cross sectional view of a portion of the latch assembly of FIG. 2, according to yet another exemplary embodiment of the present disclosure.

In yet another exemplary embodiment, and as shown in FIG. 14, the teeth 160 and the teeth 125 are omitted from the latch assembly 76. Instead, the exterior surface of the collet support 86 forms a channel 250 and the interior surface of the collet 88 forms a channel 255. During the engagement position, a snap ring 260 is compressed in the channel 250. When the latch subassembly 72 is moved to the intermediate position, the channels 250 and 255 align, thereby allowing the snap ring 260 to expand against an exterior surface of the channel 255. Due to the size of the snap ring 260, movement of the collet support 86 relative to the collet 88 corresponds to the clearance of the snap ring 260 in the channels 250 and 255.

In an exemplary embodiment, the teeth 94, 100, 102, 108, 125, 160, 150, 155, and 215 may be any type of protrusion(s) capable of creating a linear ratchet such as, for example, a gear, a thread, a rib, a rack, or other suitable devices.

Furthermore, exemplary embodiments of the present disclosure may be designed for use with any completion system or during any completion operation. A completion system includes multiple components used to prepare a well for production after it has been drilled. During a completion operation, sudden pressure differentials may occur downhole, which may be related to a fluid, for example, during a fluid hammer, or to a gas. When there is play between the mandrel 78 that is latched to the receptacle 80, the pressure differential may cause an impact load greater than the rating of the mandrel 78 or the receptacle 80. The latch assembly 76 may be utilized to prevent or limit the play between the mandrel 78 and the receptacle 80, and in turn, reduce the impact load between the mandrel 78 and the receptacle 80, as would also be understood by those ordinarily skilled in the art having the benefit of this disclosure. Specifically, when perforating guns are fired downhole, the latch assembly 76 may be utilized to reduce impact loads between the mandrel 78 and the receptacle 80. Moreover, when a jar is used above a retrieving tool, any movement or play in latched equipment may reduce the transfer of impact load to the packer assembly. The latch assembly 76 may be utilized to prevent or limit the play between latched equipment, and in turn, maximize the transfer of impact load to the packer assembly, as would also be understood by those ordinarily skilled in the art having the benefit of this disclosure. Additionally, downhole equipment may often vibrate due to, for example, gas flow. When there is play or movement between latched equipment, the latched equipment may reach its resonance frequency. Utilizing the latch assembly 76 may prevent or limit the play or movement between latched equipment, thereby preventing the equipment from reaching its resonance frequency.

An exemplary embodiment of the present disclosure provides a downhole latch assembly, including an upper completion mandrel having an external shoulder; a lower completion receptacle having an interior shoulder that engages the external shoulder of the mandrel; and a latch assembly positioned along the mandrel to secure the mandrel shoulder adjacent the receptacle shoulder. In an alternate embodiment, the latch assembly includes a lock ring concentrically disposed about an exterior surface of the mandrel; a collet support concentrically disposed about an exterior surface of the lock ring; and a collet concentrically disposed about an exterior surface of the collet support; wherein the receptacle and the collet form a first latch, the collet and the collet support form a second latch, the collet support and the lock ring form a third latch, and the lock ring and the mandrel form a fourth latch.

In another, the collet support includes an external shoulder that engages the external shoulder of the mandrel; and the collet comprises a face that engages the external shoulder of the collet support.

In yet another embodiment, the latch assembly is movable from a first position to a second position; wherein, when the latch assembly is in the first position: the external shoulder of the mandrel is engaged to the interior shoulder of the receptacle; the external shoulder of the collet support is engaged with the external shoulder of the mandrel; and the collet is engaged to the receptacle to engage the first latch; and wherein, when the latch assembly is in the second position: the external shoulder of the mandrel is disengaged from the interior shoulder of the receptacle; the external shoulder of the collet support is engaged with the face of the collet and the shoulder of the mandrel; and the collet support engages the collet to engage the second latch.

In another embodiment, the latch assembly is movable from the second position to a third position; and wherein, when the latch assembly is in the third position: the external shoulder of the mandrel is engaged with the interior shoulder of the receptacle to prevent downward movement of the mandrel relative to the receptacle; the lock ring is engaged to the collet support to engage the third latch; and the mandrel engages the lock ring to engage the fourth latch to prevent upward movement of the mandrel relative to the receptacle. In another, the first latch, the second latch, the third latch, and the fourth latch are linear ratchets. In another, the first latch prevents upward movement of the collet relative to the receptacle, the second latch prevents downward movement of the collet support relative to the collet, the third latch prevents downward movement of the lock ring relative to the collet support, and the fourth latch prevents upward movement of the mandrel relative to the lock support. In yet another, the collet support includes a first portion and a second portion, the first portion configured to detach from the second portion upon upward movement of the mandrel to allow for the latch assembly to detach from the receptacle. In yet another, the latch assembly also includes external teeth on the mandrel, internal teeth on the receptacle, internal teeth on the collet support, external teeth on the collet, internal teeth and external teeth on the body lock ring; and a shear mechanism securing the mandrel to the collet support, wherein the external teeth of the mandrel engage the internal teeth of the body lock ring, the external teeth of the body lock ring engage the internal teeth of the collet support, and the external teeth of the collet engage the internal teeth of the receptacle.

An exemplary embodiment of the present disclosure provides a method of latching a mandrel of an upper completion assembly to a receptacle of a lower completion assembly located in a wellbore, the method including lowering the mandrel having a latch assembly carried by the mandrel to a first position relative to the receptacle; raising the mandrel to position the latch assembly in a second position relative to the receptacle; and lowering the mandrel to position the latch assembly in a third position relative to the receptacle to limit upward and downward movement of the mandrel relative to the receptacle. In another embodiment, the latch assembly includes: a lock ring concentrically disposed about an exterior surface of the mandrel; a collet support concentrically disposed about an exterior surface of the lock ring; and a collet concentrically disposed about an exterior surface of the collet support; wherein the receptacle and the collet form a first latch, the collet and the collet support form a second latch, the collet support and the lock ring form a third latch, and the lock ring and the mandrel form a fourth latch. In yet another, lowering the mandrel to a first position includes: lowering the mandrel until an external shoulder of the mandrel rests on an internal shoulder of the receptacle thereby causing the first latch to limit upward movement of the collet relative to the receptacle.

In yet another embodiment, raising the mandrel to position to the second position includes: moving the mandrel, the lock ring, and the collet support in an upward direction relative to the collet and the receptacle, thereby causing the second latch to limit downward movement of the collet support relative to the collet. In yet another, lowering the mandrel to the third position includes: moving the mandrel in a downward direction relative to the collet support, the collet, and the receptacle, thereby causing the third latch to limit downward movement of the lock ring relative to the collet support and causing the fourth latch to limit upward movement of the mandrel relative to the lock ring and the receptacle. In another exemplary embodiment, lowering the mandrel to the third position relative to the receptacle to latch the mandrel to the receptacle further includes moving the mandrel in a downward direction relative to the collet support, the collet, and the receptacle, to rest an external shoulder of the mandrel upon an interior shoulder of the receptacle, thereby limiting downward movement of the mandrel relative to the receptacle. In another exemplary embodiment, lowering the mandrel to the first position comprises moving the mandrel until internal teeth on the receptacle engage external teeth on a collet and a shoulder on the mandrel seats on a shoulder of the receptacle; wherein raising to the second position comprises moving the mandrel relative to receptacle so as to separate the receptacle shoulder from the mandrel shoulder until a shoulder on collet support seats against the collet; and wherein lowering to the third position comprises applying downward force on the mandrel thereby shearing a shear mechanism securing the mandrel to the collet support, and continuing to apply downward force on the mandrel until the mandrel shoulder seats on the receptacle shoulder.

Another exemplary embodiment of the present disclosure provides a method of method of latching a mandrel of an upper completion assembly to a receptacle of a lower completion system located in a wellbore, the method including: providing a lock ring concentrically disposed about an exterior surface of the mandrel; providing a collet support concentrically disposed about an exterior surface of the lock ring; providing a collet concentrically disposed about an exterior surface of the collet support; latching the exterior surface of the collet to an inner surface of the receptacle to limit movement of the collet relative to the receptacle; latching the exterior surface of the collet support to an inner surface of the collet to limit movement of the collet support relative to the receptacle; latching the exterior surface of the lock ring to an inner surface of the collet support to limit movement of the lock ring relative to the receptacle; and latching the exterior surface of the mandrel to an inner surface of the lock ring to limit movement of the mandrel relative to the receptacle. In another, latching the exterior surface of the mandrel to an inner surface of the lock ring to limit movement of the mandrel relative to the receptacle includes: engaging exterior teeth formed on the exterior surface of the mandrel to interior teeth formed on the inner surface of the lock ring; and wherein the exterior teeth and the interior teeth are directed in opposing directions to form a linear ratchet. In yet another, the method further includes resting an external shoulder of the mandrel on an interior shoulder of the receptacle to limit downward movement of the mandrel relative to the receptacle; and wherein latching the exterior surface of the mandrel to an inner surface of the lock ring comprises creating a linear ratchet between the mandrel and the lock ring to limit upward movement of the mandrel relative to the receptacle. In yet another, latching the exterior surface of the mandrel to an inner surface of the lock ring comprises: engaging exterior teeth formed on the exterior surface of the mandrel to interior teeth formed on the inner surface of the lock ring; and wherein the exterior teeth and the interior teeth are directed in opposing directions to form a linear ratchet.

The foregoing description and figures are not drawn to scale, but rather are illustrated to describe various embodiments of the present disclosure in simplistic form. Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A downhole latch assembly for a completion system, comprising:

an upper completion mandrel having an external shoulder;

a lower completion receptacle having an interior shoulder that engages the external shoulder of the mandrel;

a latch assembly positioned along the mandrel to secure the external shoulder of the mandrel adjacent the interior shoulder of the receptacle;

a lock ring concentrically disposed about an exterior surface of the mandrel;

a collet support concentrically disposed about an exterior surface of the lock ring and about an exterior surface of the mandrel; and a collet concentrically disposed about an exterior surface of the collet support;

wherein the receptacle and the collet form a first latch, the collet and the collet support form a second latch, the collet support and the lock ring form a third latch, and the lock ring and the mandrel form a fourth latch;

wherein a first shearable mechanism couples the collet support to the collet and a second shearable mechanism couples the collet support to the mandrel; and wherein the first latch prevents upward movement of the collet relative to the receptacle, the second latch prevents downward movement of the collet support relative to the collet, the third latch prevents downward movement of the lock ring relative to the collet support, and the fourth latch prevents upward movement of the mandrel relative to the lock ring.

2. The assembly as defined in claim 1, wherein:

the collet support comprises an external shoulder that engages the external shoulder of the mandrel; and the collet comprises a face that engages an external shoulder of the collet support.

3. The assembly as defined in claim 2, wherein the latch assembly is movable from a first position to a second position;

wherein, when the latch assembly is in the first position:

the external shoulder of the mandrel is engaged to the interior shoulder of the receptacle;

the external shoulder of the collet support is engaged with the external shoulder of the mandrel; and the collet is engaged to the receptacle to engage the first latch; and wherein, when the latch assembly is in the second position:

the external shoulder of the mandrel is disengaged from the interior shoulder of the receptacle;

the external shoulder of the collet support is engaged with the face of the collet and the external shoulder of the mandrel; and the collet support engages the collet to engage the second latch.

4. The assembly as defined in claim 3, wherein the latch assembly is movable from the second position to a third position; and wherein, when the latch assembly is in the third position:

the external shoulder of the mandrel is engaged with the interior shoulder of the receptacle to prevent downward movement of the mandrel relative to the receptacle;

the lock ring is engaged to the collet support to engage the third latch; and the mandrel engages the lock ring to engage the fourth latch to prevent upward movement of the mandrel relative to the receptacle.

5. The assembly as defined in claim 1, wherein the first latch, the second latch, the third latch, and the fourth latch are linear ratchets.

6. The assembly as defined in claim 1, wherein the collet support comprises a first portion and a second portion, the first portion of the collet support configured to detach from the second portion of the collet support upon upward movement of the mandrel to allow for the latch assembly to detach from the receptacle.

7. The assembly as defined in claim 1, further comprising external teeth on the mandrel, internal teeth on the receptacle, internal teeth on the collet support, external teeth on the collet, internal teeth and external teeth on the body lock ring; and a shear mechanism securing the mandrel to the collet support, wherein the external teeth of the mandrel engage the internal teeth of the body lock ring, the external teeth of the body lock ring engage the internal teeth of the collet support, and the external teeth of the collet engage the internal teeth of the receptacle.

8. A method of latching a mandrel of an upper completion assembly to a receptacle of a lower completion assembly located in a wellbore, the method comprising:

lowering the mandrel having a latch assembly carried by the mandrel to a first position relative to the receptacle to thereby latch a collet of the latch assembly to the receptacle;

raising the mandrel to position the latch assembly in a second position relative to the receptacle and to thereby latch a collet support of the latch assembly to the collet; and lowering the mandrel to position the latch assembly in a third position relative to the receptacle to thereby latch the mandrel to the collet support to limit upward and downward movement of the mandrel relative to the receptacle, wherein lowering the mandrel to the third position comprises moving the mandrel in a downward direction relative to the collet support, the collet, and the receptacle, thereby causing engagement of the collet support and a lock ring to limit downward movement of the lock ring relative to the collet support and causing engagement of the lock ring and the mandrel to limit upward movement of the mandrel relative to the lock ring and the receptacle.

9. The method as defined in claim 8, wherein:

the lock ring is concentrically disposed about an exterior surface of the mandrel;

the collet support is concentrically disposed about an exterior surface of the lock ring; and the collet is concentrically disposed about an exterior surface of the collet support; and wherein the receptacle and the collet form a first latch, the collet and the collet support form a second latch, the collet support and the lock ring form a third latch, and the lock ring and the mandrel form a fourth latch.

10. The method as defined in claim 9, wherein lowering the mandrel to the first position comprises:

lowering the mandrel until an external shoulder of the mandrel rests on an internal shoulder of the receptacle thereby causing the first latch to limit upward movement of the collet relative to the receptacle.

11. The method as defined in claim 9, wherein raising the mandrel to the second position comprises:

moving the mandrel, the lock ring, and the collet support in an upward direction relative to the collet and the receptacle, thereby causing the second latch to limit downward movement of the collet support relative to the collet.

12. The method of claim 9, wherein lowering the mandrel to the first position comprises moving the mandrel until internal teeth on the receptacle engage external teeth on a collet and a shoulder on the mandrel seats on a shoulder of the receptacle; wherein raising to the second position comprises moving the mandrel relative to receptacle so as to separate the shoulder of the receptacle from the shoulder of the mandrel until a shoulder on the collet support seats against the collet; and wherein lowering to the third position comprises applying downward force on the mandrel thereby shearing a shear mechanism securing the mandrel to the collet support, and continuing to apply downward force on the mandrel until the mandrel shoulder seats on the receptacle shoulder.

13. The method as defined in claim 8, wherein lowering the mandrel to the third position relative to the receptacle to latch the mandrel to the receptacle further comprises:

moving the mandrel in a downward direction relative to the collet support, the collet, and the receptacle, to rest an external shoulder of the mandrel upon an interior shoulder of the receptacle, thereby limiting downward movement of the mandrel relative to the receptacle.

* * * * *